US005228751A

United States Patent [19]

Ramsden, Jr.

[11] Patent Number: 5,228,751

[45] Date of Patent: Jul. 20, 1993

[54] CONTROL SYSTEM FOR LONGWALL SHEARER

[75] Inventor: John W. Ramsden, Jr., Huntsville, Ala.

[73] Assignee: American Mining Electronics, Inc., Huntsville, Ala.

[21] Appl. No.: 771,771

[22] Filed: Oct. 4, 1991

[51] Int. Cl.[5] ..... E21C 35/12; E21C 35/24

[52] U.S. Cl. ..... 299/1.6; 299/42

[58] Field of Search ..... 299/1.1, 1.2, 1.6, 42

[56] References Cited

U.S. PATENT DOCUMENTS 4,371,209 2/1983 Alford et al. ..... 299/1.6
4,634,186 1/1987 Pease ..... 299/1.6
4,643,482 2/1987 Wolfenden ..... 299/1.6

FOREIGN PATENT DOCUMENTS 2027548 2/1980 United Kingdom ..... 299/1.6

*Primary Examiner*—David J. Bagnell
*Attorney, Agent, or Firm*—Phillips & Beumer

[57] ABSTRACT

Apparatus for measuring the degrees of roll of the body of a longwall shearing machine and providing signals proportional to the roll angle which are used to control drum cutting positions for controlling roof and floor horizons of a coal tunnel.

7 Claims, 7 Drawing Sheets

CONTROL SYSTEM FOR LONGWALL SHEARER

FIELD OF THE INVENTION

This invention relates generally to the control of longwall shearer mining machines and particularly to the automatic positioning of the cutting drum or plowing type material extraction equipment mounted on these machines.

BACKGROUND OF THE INVENTION

Longwall mining is a highly productive type of mining requiring a highly specialized machine. The mining environment for using this longwall machine must be prepared before machine installation can be carried out. A block of coal (or other minable material), called a "panel," is established by defining the panel perimeter within the material seam by tunnelling. Typically, the panel is 500 to 1,000 feet across and 5,000 feet in length. Tunnels along the length of the panels are used for entrance by personnel and equipment and are used for material removal after extraction by the longwall shearing machine. The shearing machine is established at one end of the panel, and a track is build along the width for it to traverse. The track is constructed by joining sections together to form the basis for the machine travel path and to construct the face conveyor system onto. The sections are typically called "pans", and the pans are typically about five feet in length. The track, shearer machine, and personnel are protected from cave-ins by a series of roof support shields which are also typically about five feet in length. The shearing machine is constructed to have one or more ranging arms with material extraction devices on the end(s). The ranging arms are pivoted at one point, and the arm is rotated about this point for the purpose of positioning the extraction end of a desirable height for material extraction or clearance. The extraction operation is performed by the shearing machine traversing the width of the panel, cutting the material from the seam wall, called the "face," and the material being removed by a face conveyor system. The machine travels in both directions and, as one full cut is completed, the roof support shields, conveyor, and machine are advanced into the face for the next cutting sequence. This material extraction and advancement of the equipment will continue until the panel is completed. Coal seams mined in this manner are usually in the range of 48 to 144 inches in vertical thickness, with an adjacent region above and below a seam of varied composition. Frequently, the adjacent region is of clay or other unstable material, and for this reason, the tunnel in which the cutting operation occurs is often formed in the coal to maintain the integrity of the tunnel above and below the cutting machine during its pass through the tunnel. As conditions may require, from two to six inches of coal may be left on the ceiling and/or floor. For example, sufficient thickness of coal on the floor is necessary to support the weight of the shearing machine and roof supports in areas where soft floor materials are prevalent. Alternately, if a greater amount of coal is left than actually required, the economic impact is substantial and can run into the millions of dollars if such deviations persist during significant mining operations. In addition, automated positioning of the cutting drums can result in smoother cuts with less steps, etc., which reduces equipment breakage and maintenance. Also, operating personnel can move away from the cutters, reducing their exposure to coal dust and flying debris.

The obvious problem is how to accurately track and follow a coal seam and its boundaries. If coal seams were level, the task would be relatively simple, but they are not. Instead, they largely tend to follow a constantly changing slope and, in fact, in many instances, conform to sine waves with amplitudes typically running from 3 to 12 feet and periods of typically 50 to 100 feet. Another and related factor is that the cutting or shearing drums of the cutting machine extend significantly beyond the ends of the machine and cut to the side of the machine and thus form a tunnel for the next pass by the machine. The problems that arise will be appreciated from a brief examination of operation.

Assume first that an initial tunnel is precisely cut between access tunnels along a seam and that it has a known sine wave contour. A track, made of sections generally referred to as pans, is laid through the tunnel beside a face of the seam to be sheared. The shearing machine is then positioned on the track, and its initial task is to make a first cut in the face of the seam, beside the initial tunnel. Ideally, a cutting drum would be set at one elevation to cut either the floor or ceiling of a new cut which is identical with the ceiling or floor elevation of the initial tunnel. Unfortunately, while the machine body is typically supported by its four rollers or support slides in the initial tunnel, a cutting drum is in advance of the body of the machine by several feet as it cuts, in effect, a new tunnel. The result is that the elevation of the body is in terms of the slope of the tunnel under it, whereas the cut made by the cutter, to the side of the initial cut, is in advance of the body of the machine. As a result, a single relative position of the drum with respect to the machine will not produce side-by-side like contoured cuts. If one does proceed in a single position of the drum, there will be produced a new cut which will follow a sine wave, but this sine wave will be longitudinally displaced with respect to the sine wave contour of the original tunnel, and it thus will not conform to the coal seam. To make matters worse, actual measurement of the position of the drum with respect to the floor is not possible because of a too-hostile environment for instrumentation.

Because of these factors, it was necessary to devise systems for automated control of a longwall shearer. One such system (which is incorporated herein) is disclosed in U.S. Pat. No. 4,634,186, entitled "Control System For Longwall Shearer," issued to Robert E. Pease on Jan. 6, 1987. In this patent, a series of coal thickness sensors are employed, as in the pan track assemblies upon which the shearer rides. During the period that the track is positioned in one position for a face cut, for example, 15 to 20 minutes, these sensors each determine the thickness of the coal at their location. For example, they may be 20 to 50 feet apart. Each reading is compared with a selected thickness and a difference quantity, indicating, by one sign, less thickness than desired, or by the other sign, a greater thickness than desired; or, if the comparison provides a zero, then the ideal thickness obtains. The difference figures for the series are typically arranged in some format to determine a smooth curve of cut corrections along the track and these placed in a memory. Then, as the machine traverses the track during the next path of the shearer, corrections are taken from the memory corresponding to measured locations and added to or subtracted from the elevation of the cutter at that location.

This provides an extremely precise control of coal thicknesses left at the ceilings and floors of the coal. At the same time, or if no coal thickness sensors are employed, manual offsets may be entered to readjust the floor or roof elevation if required at discrete locations on subsequent passes.

The applicant has provided a control system which includes inclinometers mounted in predetermined angular relation on the ranging arms to provide instantaneous output signals indicative of the roll and pitch attitude of the cutting drum. Such output signals are used to control the angle at which the cutting drums engage the face at subsequent passes of the drums across the face.

SUMMARY OF THE INVENTION

In accordance with this invention, the inclination of the shearer body and cutter arms with respect to the body are measured as is the traverse of the machine through a tunnel as it makes a cut. From these measurements, a rate of change of angle for distance traversed is determined. Additionally, constants relating to the offset position of the cutter with respect to the body of the shearer are determined. One of these is relative to the shearer slope and the other relative to the rate of change of this slope with respect to distance traversed by the machine. These constants are employed in the generation of an amplitude offset which, when applied to a fixed elevation of a cutter, will replicate the cut on which the machine rides.

A feature of the present invention is the employment of inclinometers positioned in predetermined angular relation on the ranging arms relative to the longitudinal axis of the machine body to determine the roll angle (tilt angle of the shearer body relative to the face) at predetermined points along the track. This angular information is stored in memory so that it may be replicated in the next traverse of the face at the predetermined points, and subsequent cuts may be altered, compensating for body "roll" errors that would otherwise occur. A further feature of the invention is a method whereby the predetermined angular relation of the inclinometer relative to the longitudinal axis of the body is determined.

DETAILED DESCRIPTION OF THE PREFERRED EMBODIMENT

Figure 1:
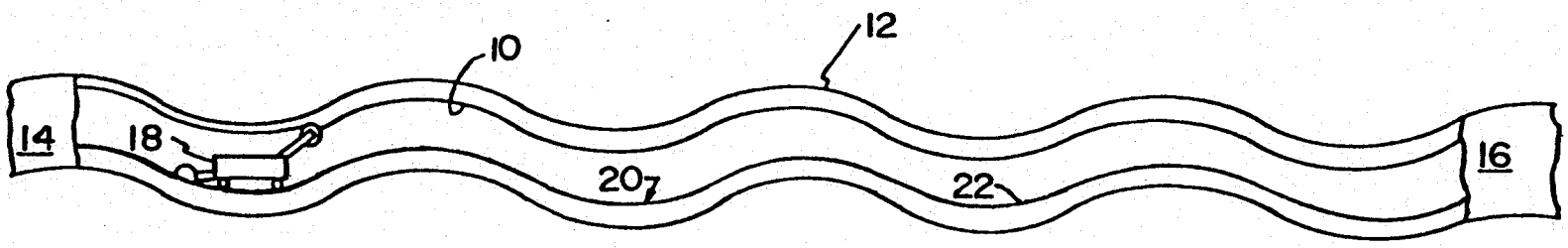
FIG. 1 is a diagrammatic illustration of a portion of a tunnel through and following a seam of coal and showing in place a longwall shearing machine.

Referring initially to FIG. 1, a face tunnel 10 is cut through a seam of coal 12 between access tunnels 14 and 16 to accommodate a longwall coal shearing operation, the longwall extending between the access tunnels and being a longwall of the coal seam. A track 20 formed of five-foot sections, and referred to as pans 22, are laid on the floor of the tunnel.

Figure 2:
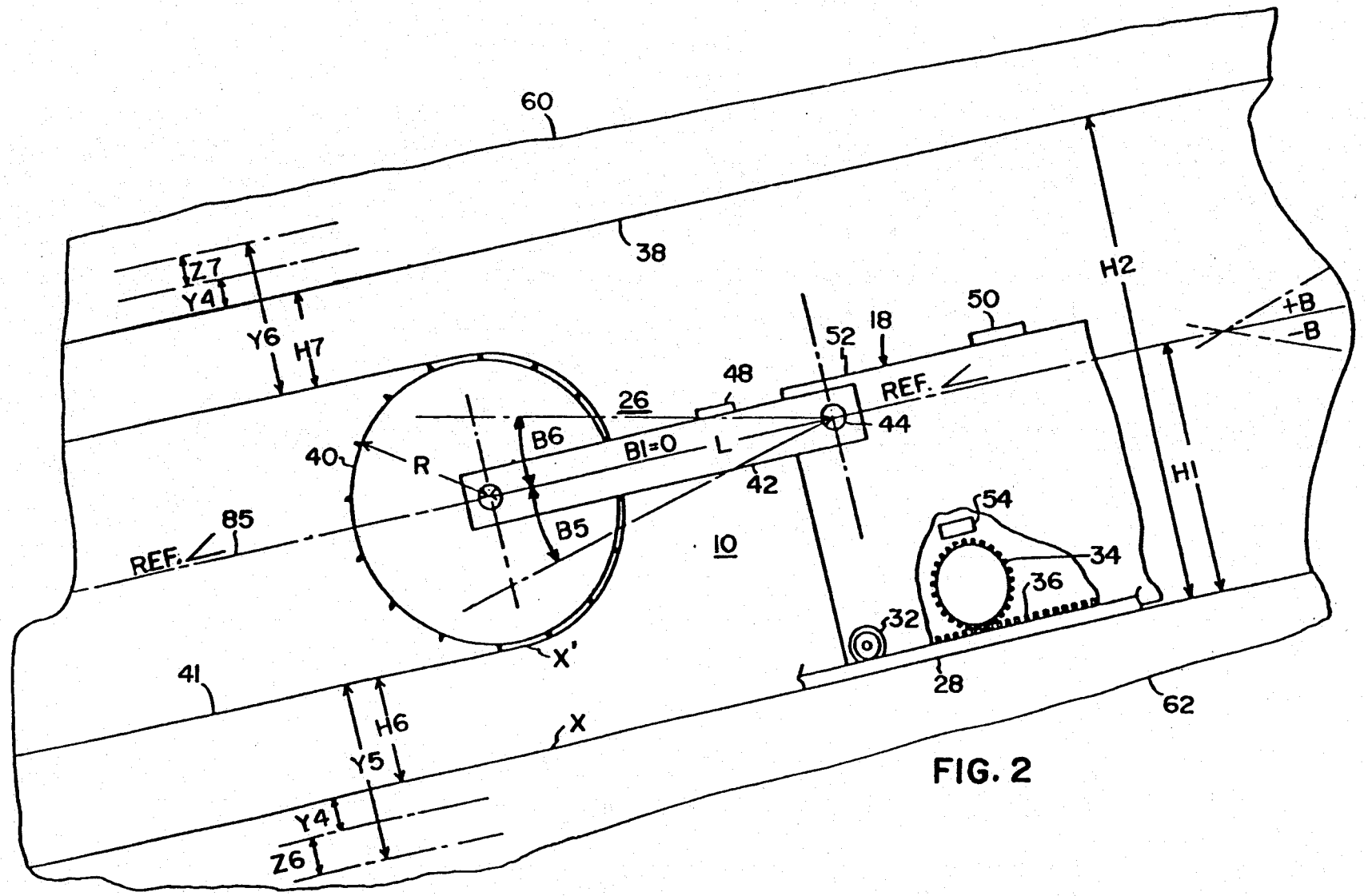
FIG. 2 is a diagrammatic illustration showing as a side elevational view a portion of a coal shearing machine and certain dimensional measurements and relationships considered by this invention.
Figure 3:
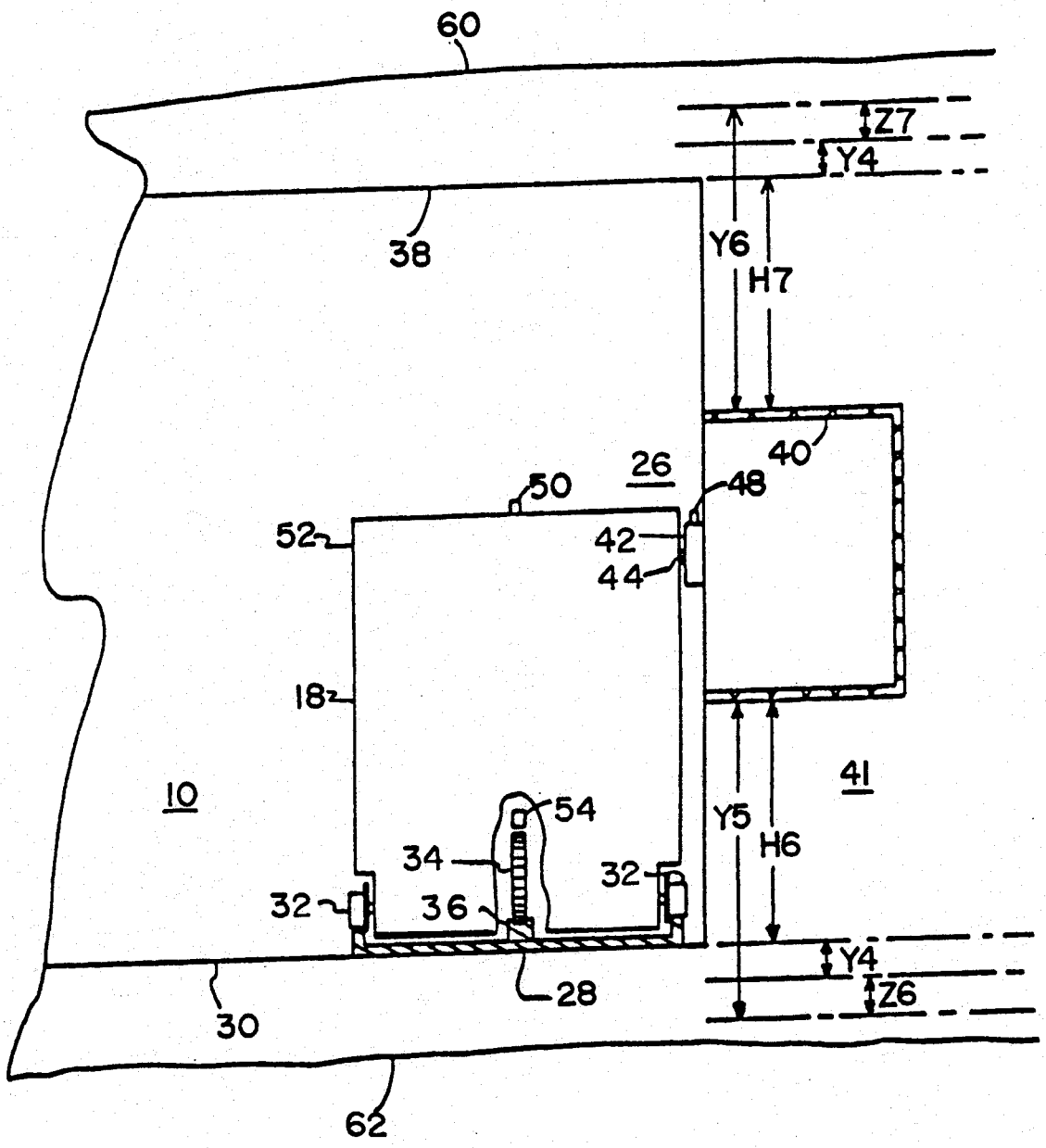
FIG. 3 is a diagrammatic illustration of an end elevational view of the machine shown in FIG. 2.

FIG. 2 illustrates the geometry of a shearing machine 18 with one end portion broken away and thus showing only a single cutter assembly 26. The omission is permissible since an opposite ended cutter would be operated in the same manner and for the further reason that some longwall shearers employ a single cutter, and even those that employ two are often used in a single cutter operation. To examine the geometry of operation, FIG. 3 illustrates, diagrammatically, the position of a pan section 28 which is laid on the floor 30 of tunnel 10. Shearing machine 18 includes rollers 32 which support the machine on pans 28, the machine being driven by a gear or cog wheel 34 powered by a motor (not shown) in machine 18. Cogs of the wheel mesh with a rack 36 in each pan section, and thereby the machine is driven along the tunnel. Actually, these structures are shown diagrammatically and would, in fact, be positioned to the side of the assemblies as a coal conveyor is actually operated under machine 18 to remove the coal as it is cut. For purposes of illustration, tunnel 10 is shown as having a ceiling 38. Cutting drum 40 of cutter assembly 26 is rotatably mounted on an arm 42 and is rotatably driven by means not shown. Such mounting is at one end of arm 42, and arm 42 is pivotally supported at an opposite end by a shaft 44 which is typically rotatably driven to raise and lower the opposite end of arm 42 by a hydraulic drive, identified as arm cylinder 46 in FIG. 4. Arm inclinometer 48 is positioned on arm 42 and measures the inclination of the arm with respect to a plane normal to gravity, and an inclinometer 50 is attached to the body 52 of shearer 18, and it measures the inclination of the body of the shearer with respect to a plane normal to gravity. A cog counter 54 is positioned adjacent to wheel 34, and it contains two sensing coils which respond to the passage of a cog or gear and together provide an output indicative of travel of shearer 18 in either direction of travel of machine 18 from a reference count, or zero.

Figure 5:
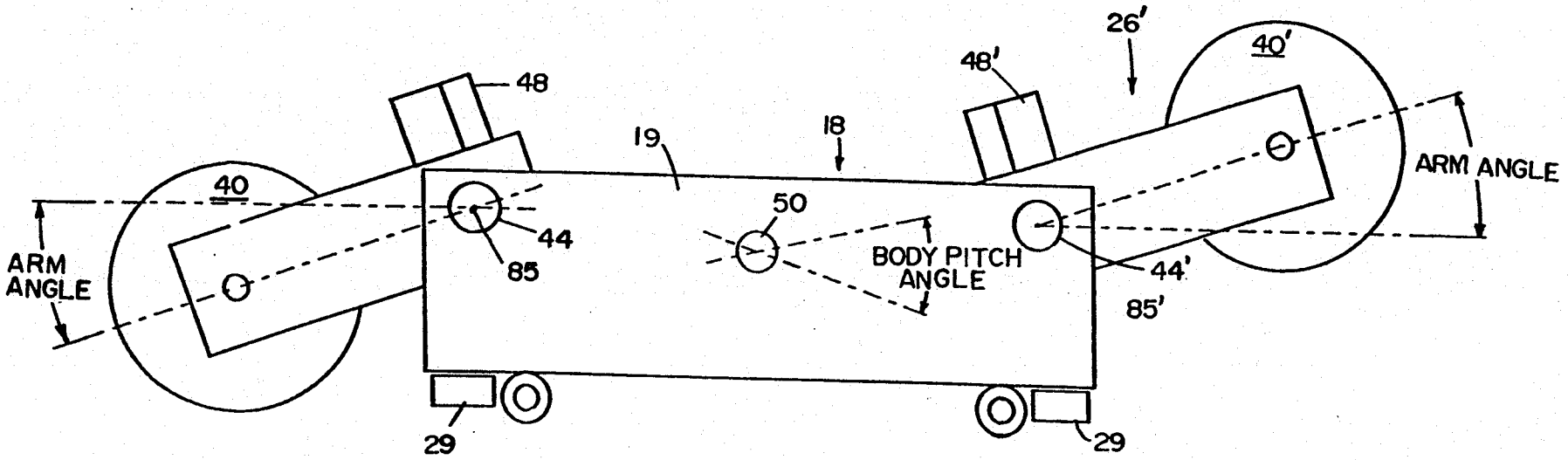
FIG. 5 is an elevational view of the machine body illustrating the use of two ranging arms and drums.

It is to be understood that while FIG. 3 illustrates the use of rollers 32 on the inner and outer lower surfaces of body 19 of machine 18 to aid in movement of the machine along track 20, other means of support may be resorted to as shown in FIG. 5, which shows a pair of outer support members 29 having a downwardly projecting hook-like portion (not shown) for engaging the track. This structure is typically known as a trapping shoe. The inner wheels 32 of FIG. 3 may be replaced by a support pad (not shown), known typically known in the art as a skate, if desired.

Figure 7:
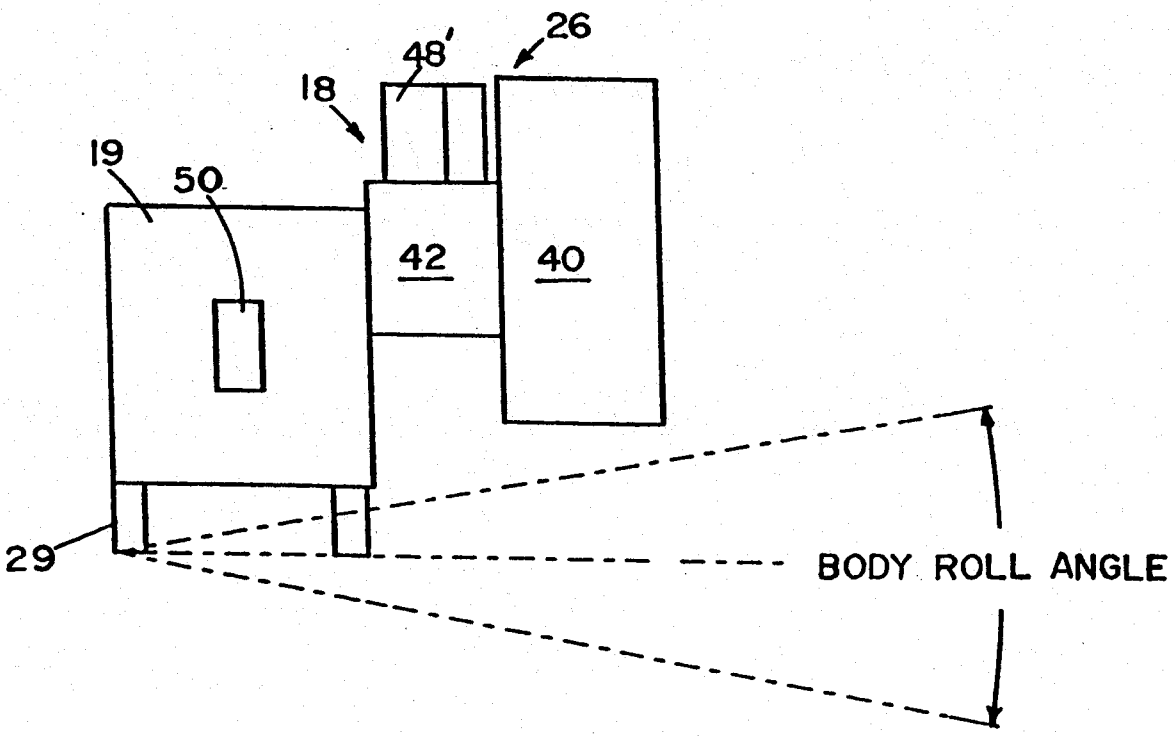
FIG. 7 is an end elevational view of the device of FIG. 5 and also illustrating the body roll angle.

As seen in FIG. 5, shearing machine 18 is provided with a pair of cutting assemblies 26 and 26, having support skates and trapping shoes 29 secured to body 19 for movably supporting the shearer machine on the track. Cutting assemblies 26 and 26' respectively include a pair of ranging arms 42 and 42' for support of drums 40 and 40'. Arm inclinometers 48 and 48' are positioned in angular relation on arms 42 and 42' to measure the inclination of the respective arms with respect to a plane normal to gravity and to also measure the roll angle of body 19 as described hereinbelow. FIG. 7 illustrates the roll angle.

Figure 6:
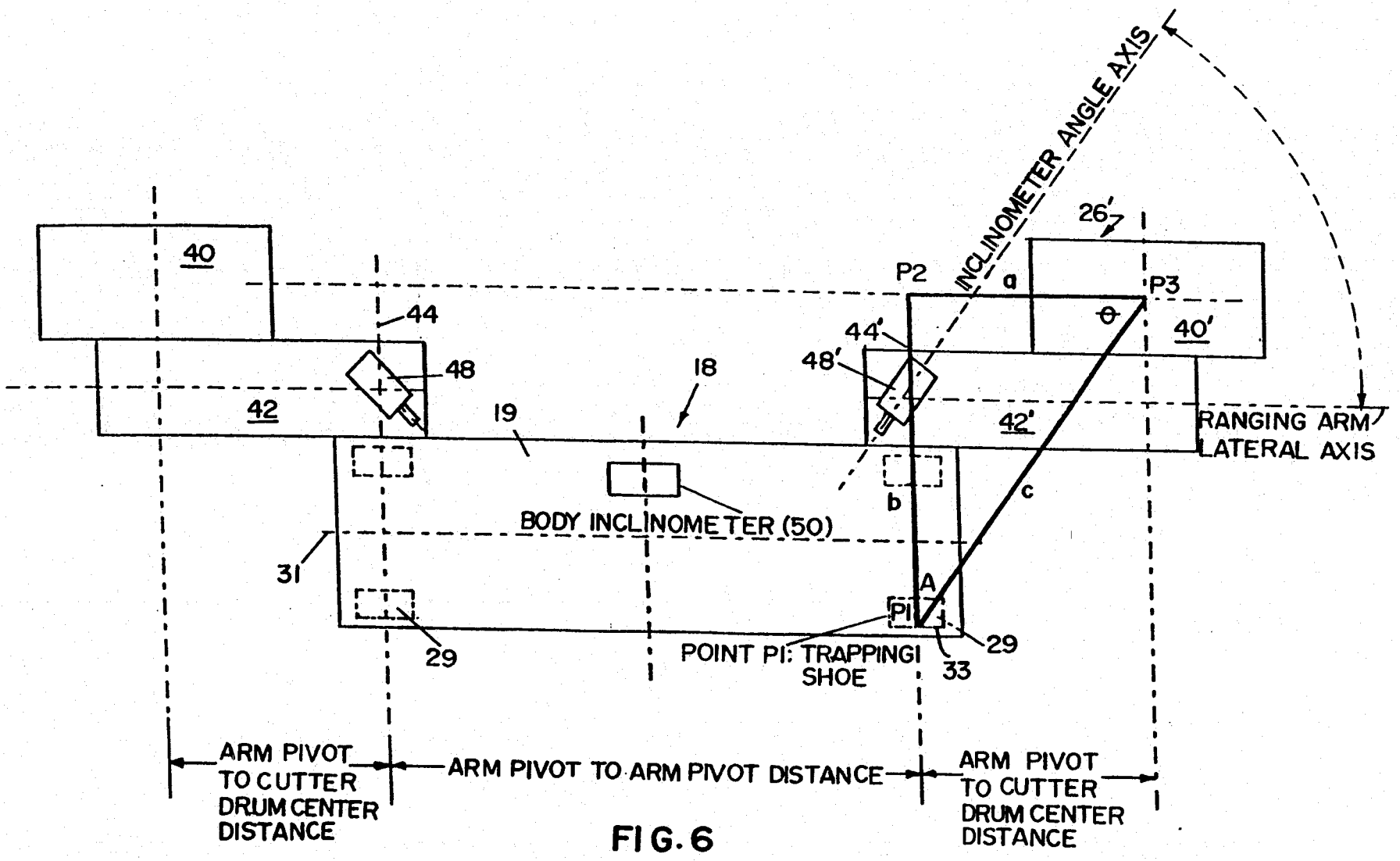
FIG. 6 is a plan view of the device of FIG. 5 and illustrating the angular relation of the arm inclinometers relative to the longitudinal axis of the shearer body.

FIG. 6 is a plan view of FIG. 5 and illustrates the manner in which the positional angle of inclinometer 48' is determined. A triangle is formed between points P1, P2, and P3, wherein P1' is a pivotal point on the outermost surface 33 of the support (including the pan) or trapping shoe 29. A line b drawn from P1 through the rotational axis 44' of arm 42' (perpendicular to body axis 31) defines one side of the triangle. The intersection of a line a extending from the longitudinal axis of cutter drum 40' to its point of intersection with line b defines point P2, at the point of intersection. Lines a and b form a 90° angle. A line c extending from the intersection of the rotational axis of cutter drum 40' to point P1 defines the third leg of the triangle. It is only necessary to calculate angle $\theta$ (the angle between lines a and c) to determine the angle which the inclinometer must be mounted on the ranging arm 42' relative to longitudinal axis 31 of body 19. Such calculation is made from the formula:

$$\theta = Tan^{-1}(b/a).$$

It should be understood that the angle $\theta$ is calculated from a triangle based upon individual machine component geometry and applied to the arm inclinometers. End points P1, P2, and P3, may require adjustment to triangle side lengths depending upon actual machine performance characteristics. It is to be further understood that the point P1 is chosen to be at the outermost surface of the outside bottom support; however, other points which may be part of the machine geometry which extend from the "gob" side (outermost side of body 19) may be used as point P1.

It is to be further understood that the method just described for positioning inclinometer 48' on arm 41' is also used in positioning inclinometer 48 on arm 42. Also, the arm inclinometers may be positioned on the top, bottom, or inside of the ranging arm, as desired.

The control system employs a number of parameters which are illustrated in FIGS. 2 and 3. They are listed together with their definitions as follows:

- T2=shearer location; present cog count reading (1 cog =4.92 inches) as determined from cog count sensor on drive gear
- T8=previous cog count reading
- G8=ABS (T2-T8); absolute delta cog count value
- B0=instantaneous shearer body angle reading
- B=present average body angle with respect to gravity (degrees)(average of 16 readings in 500 milliseconds) as determined from body inclinometer
- B8=previous average body angle reading (degrees)
- A=B-B8; delta body angle value (degrees)
- I1=A8/G8 body angle rate of change (degrees/cog distance)
- H1=height of arm pivot center above floor (inches)
- H2=height or distance between floor cut and roof cut (inches)
- H6=height of lower cutter edge above floor (inches) when cutter arm angle=0° with respect to shearer body angle
- H7=height of roof above upper cutter edge when cutter arm angle=0° with respect to body angle
- Z6=floor cut, cutter height adjustment value (inches)
- Z7=roof cut, cutter height adjustment value (inches)
- K3=floor profile amplitude compensation factor
- K4=floor profile period compensation factor (NOTE: K3 and K4 are emperically determined by simulation program for various floor profiles)
- Y4=(K3 * B)+(K4 * I1); delta cut height compensation for floor profile characteristics
- Y5=(floor cut)=Y4+H6−Z6; required delta height of lower cutter edge below reference
- Y6=(roof cut)=Y4+H7+Z7; required delta height of upper cutter edge above reference
- R=cutting drum radius (inches)
- L=arm length (distance from arm pivot to drum center) (inches)
- B5=SIN(−1)Y5/L; required new arm angle (degrees) if floor cut
- B6=SIN(−1)Y6/L; required new arm angle (degrees) if roof cut
- B1=(1/COS K9); instant inclinometer reading for head gatewhere K9=$\theta$=inclinometer rotation angle
- B2=(1/COS K9); instant, inclinometer reading for tail gate where K9=$\theta'$=inclinometer rotation angle
- IF B1>(B5+L1), arm too high, adjust down
- IF B1>(B5 - L1), arm too low, adjust up Referring again to FIGS. 2 and 3 and the foregoing definitions, it is to be borne in mind that in the sequence of cutting, the machine itself is supported in one tunnel, in this case, tunnel 10, while cutting in a second tunnel beside tunnel 10. Assuming that the first tunnel is correctly cut, it is the goal to make a cut conforming in amplitude and phase with the contour of the first tunnel, taking into account the correctness of the coal thickness of the floor and ceiling of the original tunnel. Thus, if, for example, the original ceiling thickness of coal from ceiling 38 to the outer boundary 60 of the ceiling of the coal seam were two inches and the thickness of the coal between floor 30 and the lower boundary of the seam 62 were approximately six inches, an ideal amount of coal would have been removed when, in all places, the resulting second tunnel is identical to the first one. In controlling cutting drums 40 and 40', it is to be kept in mind that one does not have the luxury of actually measuring the distance between cutters 40 and 40' and a surface being cut. Thus, the dimensions Y6, H7, Y5, and H6 are not measurable. Measurement is prevented by virtue of there being no known way of locating instruments which make such measurements in the environment. In fact, because of this, the basic problem of control arises. The determination of these referenced dimensions and use by applicant's system provide a most effective control.

Figure 4:
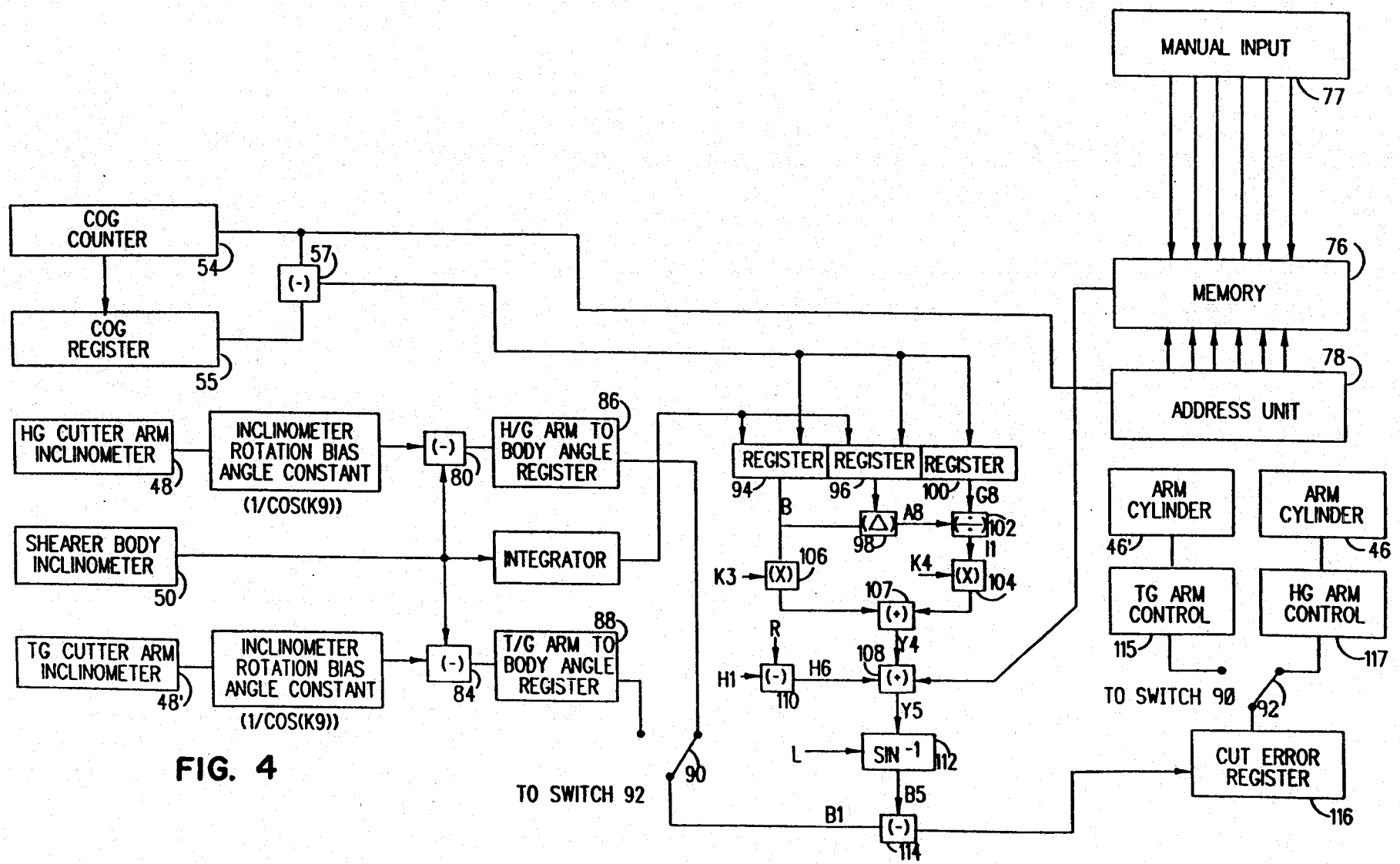
FIG. 4 is an electrical block diagram of the system of this invention.

The electrical system of this invention is particularly illustrated in FIG. 4 in terms of making a floor cut with cutters 40 and 40' of cutting machine 18 positioned on a track in tunnel 10 but with the cutters making their cut in what will become a new tunnel 41.

Assuming that cutter 40 is the head gate (H.G.) cutter or machine 18, inclinometer 48 provides a signal output to difference unit 80 indicative of the inclination of arm 42 (FIG. 2). An identical cutter arm inclinometer 40' is mounted to an identical arm 42' on the opposite end of machine 18 as is a tail gate (T.G.) cutter arm inclinometer. Each inclinometer provides an electrical output indicative of the cutter arm inclination (with respect to a plane normal to gravity and with respect to the roll, or horizontal axis 31 of body 19) to difference units 84 and 86. Body inclinometer 50 provides an output indicative of the inclination or attitude of shearer 18 (also with respect to a plane normal to gravity) as a second input to each of difference units 80 and 84. The outputs of difference units 80 and 84, being the difference in slope or angle of the cutter arms 42 and 42' and body 19, provide relative angle outputs, that is, difference unit 80 provides as an output a signal representative of the angle that arm 42 makes with reference line 85 which passes through the center of shaft 44 and a like shaft 85' pivotally holding the arm of the tail gate cutter. Difference unit 84 provides the same output with respect to a tail gate arm. For purposes of illustration, the angular inputs are indicated as being available from register 86 and 88, fed respectively from difference units 80 and 84. The outputs of registers 86 and 88 are provided to selector switch 90, which is shown as a means of illustrating that alternate values to be processed further would derive either from register 86 or register 88 and would be employed as illustrated by selector switch 92 ganged with switch 90 to control arm cylinders controlling the angular position or either the head gate or tail gate cutter arms. Again, for purposes of illustration, the operation of the system is described in terms of the control of cutter assemblies 26 and 26' to make a floor cut (a ceiling cut would be similarly controlled).

To examine the employment of the signal outputs of the cutter and shearer body inclinometers, at this point, it is well to state that a basic function of the system is to control the relationship of the angle of the cutter arms to their support platform, namely, machine 18, and to do this while the attitude of the support changes. We do make the assumption that this change follows the coal seam in a sinusoidal pattern as illustrated in FIG. 1 and particularly that the attitude of the platform and rate of change of it follows the floor of the tunnel to provide identity data as to discrete points on a sine wave having the amplitude and period of the one shown for tunnel 10. Thus, with this it was determined there should be a translation factor or factors, including the factor identified here as K3 and K4 which, when applied to the attitude and rate of change of it (with distance) at a point on the floor of tunnel 10, would define the difference in position of a point of engagement, e.g., a roller 32 of machine 18 and the point of engagement X' of a cutting drum 40, for example, cutting drum 40, with a point X on the floor, which point is an intersection of a line parallel with the rollers of machine 18 (only roller 32 at one end is shown, but a similar roller would be visible at the same distance from reference line 86 at an opposite end of machine 18) and a vertical line extending through the center of drum 40. In any event, it is to be appreciated that point X' on drum 40, or where it engages the floor, is at the end of a moment arm from roller 32, and thus it is to be appreciated that point x' will not track and ride along the floor of the seam making up tunnel 41. However, it will conform to a sine wave, but its period and amplitude will vary as a result of the moment arm. These phase and amplitude differences between the cutter and the sinusoidal floor profile constitute the principal error to the desired cut, namely, a cut which will match the previous cut upon which the shearer its track now rests. This error can now be cancelled by using derived constants K3 and K4 in conjunction with the measured body pitch angle and its rate of change. The resulting computation has been described previously as Y4, "delta height compensation factor for floor profile." An example of the determination of K3 and K4 factors follows, using typical shearer geometry and typical seam profile data (determined by previous observation of the mine site):

SHEARER GEOMETRY

Physical Measurements:

1. C/L (center line) to C/O of forward (head gate and rear (tail gate) rollers = 105 inches
2. C/L rear roller to tail gate cutter drum C/L = 114 inches
3. C/L front roller to head gate cutter drum C/L = 114 inches
4. C/L tail gate and head gate arm pivots to cutter drums C/L = 75 inches
5. Cutter drum diameter = 57 inches; radius = 28.5 inches
6. Height of arm pivots C/L above floor = 38.5 inches
7. P1 = a point on the lower outermost surface of the shearer body support
8. P2 = a point of intersection of a line coincident with the line of a cutter and a line extending from P1 which is normal to the longitudinal axis of the shearer body
9. P3 = a point of intersection of the longitudinal axis and rotational axis of the cutter

COAL SEAM GEOMETRY

Sinusoidal period = 240 cogs, or 1,180.8 inches or 98.4 feet Sinusoidal amplitude (peak to peak) = 124 inches or 10.3 feet or +3° maximum body angle Procedure:

1. Computer simulation program calculates resulting floor cut of machine traveling on track having the given sinusoidal parameters. Cutter arm is assumed fixed so as to provide a cut even with present floor, if floor were flat and level.
2. On a sinusoidal floor the motion of the cutter because of machine + pitching will produce a sinusoidal cut which is out of phase with the floor. This error, it is noted, is equal to the amount of + cutter elevation adjustment required. This parameter is called E4.

$$Y4 = K3 * B \text{ (body angle)} + K4 * I1 \text{ (body angle rate)}$$

3. The values of K3 and K4 are selected and submitted in the computer simulation equations until Y4 = E4 or until Y4 = E4 + X.
   Where X = delta inches of coal to be trimmed off the top of the hills and delta inches of coal to be filled at the bottom or valleys.
   The latter procedure is done if the mine operator desires a smoother floor cut than that which would occur by following the natural seam boundary.
4. For the geometry and seam conditions described previously and where X = 1.5 inches:

$$K3 = 0.10;\ K4 = 60$$

As stated, one of the factors dealt with by the system is the slope or incline of shearer 18, and it is obtained from shearer body inclinometer 50. In order to ensure accuracy, a series of inclinometer readings are taken and integrated or averaged over a period of approximately one second. These are sequentially stored each time the machine traverses a selected distance. Distances are obtained from cog counter 54, and incremental distances between sampled inclinometer readings are obtained by storing a cog count in cog register 55 until a new count output of cog counter 54 occurs. Thus, there is provided to difference unit 57 two counts which enable it to provide an output indicative of the distance covered between counts. This distance value is supplied an stored in register 100. The inclinometer readings are also sequentially obtained and stored at the same rate in registers 94 and 96 so that there is the present angle stored, for example, in register 94 and the last previous angle stored in register 96 and concurrently the distance traveled between the registering of these angles stored in register 100. The outputs are coordinated by triggering angular inputs into register 94 and 96 by an output or trigger output of difference unit 57 as it outputs to register 100 The difference between the outputs of register 94 and 96 are obtained as A8 by difference unit 98 and supplied to divider 102, which is also supplied the G8 output of register 100. Thus, this value, G8, when divided by divider 102 into the angular change A8 output, provides an output I1 which is a signal indicative of the rate of change of slope of machine 18 for a discrete distance traveled by the machine. This value is supplied to multiplier 104. An angular output B of, for example, register 94, is indicative of the then slope of machine 18 and is fed to multiplier 106 to which is also fed the constant K3. The outputs of multipliers 104 and 106 are summed in adding unit 106 to provide as an output the desired elevational distance Y4, representative of the offset or correction position to cause cutter 40 to be in a correct cutting position to cut an identical and in-phase sine wave pattern to that formed by tunnel 10 in which machine 18 is supported and runs.

As described above, means are also provided to make a cutting correction to deal with thickness errors of tunnel 10, and these are in the form of a signal Z7 from memory 76. In essence, it applies a correction to a replica of tunnel 41 at a discrete point along the tunnel in its determination of a new cut. A signal Z7 thus would be added to or subtracted from a signal Y4 depending upon the relative signs of the signals to either increase or decrease the depth of cut as indicated by the nature of correction desired. This summing function is accomplished by adder 108. In addition, however, in order to provide an absolute elevational control signal, and with reference to FIG. 2 with respect to a floor cut, the additional dimensional factors H1 and R are necessary to provide a cut up to the desired final floor position indicated at the bottom as dimension Z6. Thus, subtraction unit 110 effects a subtraction between the terms H1 and R to provide the additional element H6, which would be then added by adding unit 108 to factors Y4 and Z6 to provide a final elevational dimension for a cut indicated as Y7. Arc sine unit 112 then receives the quantity Y5 and arm length L of arm 42 and provides as an output angle B5, which is the angular position of arm 42 to cause drum 40 to cut downward to a floor position indicated at the bottom of dimension Z6.

The actual instantaneous position of arm 42 would be that in head gate arm to body angle register 86. This would be supplied by a register 86 through switch 90 as angle B1 to difference unit 114 to thus provide an electric output indicative of the change that would need to be made in the angle of arm 42 to finally effect the indicated cut. This value is stored in cut error register 116 and is supplied through switch 92 to a head gate arm control unit 117 which then applies a selected hydraulic input and pressure to hydraulic cylinder 46 until angles B1 and B6 are identical, at which time hydraulic pressure would be removed or otherwise controlled to cause arm cylinder 46 to be raised to make another cut. Alternately, tail gate control would be effected through ganged switches 90 and 92 to tail gate arm control 115.

It is to be appreciated that the same approach would be employed to make roof cuts, it only being necessary to provide the correct sign as to corrections and certain other parameters. Thus, the input to adder 108 would be H7, which is equal to H1 + H2, and the output of adder 108 would be Y6 instead of Y5 as these terms are illustrated in FIG. 4.

It is to be further appreciated that the control system shown in FIG. 4 may be programmed into a general purpose, or special purpose, computer to perform the functions illustrated by a serial signal system rather than parallel, as shown.

It is also to be understood that the inclinometers used in practicing the invention are well known in the art and may be similar to those manufactured by American Mining Electronics Model 8041HB.

It is to be further appreciated that the control system shown may be manually operated by entering manual offsets as shown in FIG. 4 to readjust the floor or roof elevation if required at discrete locations on subsequent passes.

I claim:

1. A mining machine steering control system for use with a longwall shearer including a body having a longitudinal roll axis and at least one ranging arm rotatably mounted on said body of said shearer and an extraction device mounted on the distal end of said ranging arm for providing a cut into the face surface of a panel to be mined, said steering control system comprising:

actuating means for pivotally rotating said ranging arm for controlling the elevation of said extraction device;

first inclinometer means mounted on said body to provide first electrical signals indicative of the inclination of said body relative to a plane normal to gravity;

second inclinometer means including a single inclinometer mounted off said shearer body and on said at least one ranging arm in predetermined angular relation relative to said longitudinal roll axis of said shearer body, to respectively sense shearer body roll angle and arm pitch angle and to provide electrical signals indicative thereof; and control means responsive to said first and second electrical signals for actuating said actuating means for rotation of said at least one ranging arm whereby said extraction device is positioned to replicate the initial said cut in subsequent passes of said shearer.

2. Apparatus as set forth in claim 1 including body support means for supporting said body for movement along said face surface of said panel and wherein said predetermined angular relation of aid second inclinometer means is determined by forming a triangle between points P1, P2, and P3, wherein P1 is a point on the outermost surface of said body support means, and a line b extending through the rotational axis of said arm defines one side of said triangle; P2 being defined as the point of intersection of a line a extending from the longitudinal axis of said drum and extended line b; and point P3 being defined by a line c extending from the intersection of the rotational axis of said drum to P1, the angle formed at P3 being denoted as $\theta$ and being shown by the formula:

$\theta = Tan^{-1}(b/a)$ where b=distance of line b, and a=distance of line a.

3. Apparatus as set forth in claim 2 including a track positioned adjacent to said face surface and said body support means being disposed for movable support of said shearer body in said track.

4. Apparatus as set forth in claim 3 including sensing means responsive to the movement of said body along said track for providing third electrical signals representative of the movement of said shearer body along said track.

5. Apparatus as set forth in claim 4 wherein said control means includes:

first computational means responsive to said first and said third electrical signals for providing, as fourth electrical signals, signals representative of changes of said first electrical signals in relation to changes of said third electrical signals;

second computational means responsive to the sum of a first constant times said first signals and a second constant times said fourth signals for providing fifth signals representative of the difference in the elevation of said shearing drum from a sine wave elevational contour formed by said track and when maintained at a fixed elevation as said shearer traverses said track; and means responsive to said fifth signals and said second signals for providing actuating signals to said actuating means for rotating said arm and controlling the elevation of said extraction device.

6. Apparatus as set forth in claim 5 wherein said control means further includes:

memory means responsive to said second electrical signals of said second inclinometer means for storing a plurality of signals which are a function of roll displacement of said body; and means responsive to said plurality of signals which are a function of roll displacement of said body, said fifth signals and said second signals, for providing actuating signals to said actuating means for rotating said arm for controlling the elevation of said extraction device by a factor which includes the positional angle of said second inclinometer relative to said longitudinal axis of said body.

7. Apparatus as set forth in claim 6 including a first arm mounted at a first end of said body and extending away from said body in substantially parallel relation with the longitudinal axis thereof; and a second arm mounted at a second end of said body and extending away from said body in substantially parallel relation with the longitudinal axis thereof, and said second inclination means being defined as first and second inclinometers, said first inclinometer being mounted on said first arm in said predetermined angular relation, and said second inclinometer being mounted on said second arm in said predetermined relation.

* * * * *